US011187115B2

(12) United States Patent
Bayrakdar

(10) Patent No.: US 11,187,115 B2
(45) Date of Patent: Nov. 30, 2021

(54) CAMSHAFT ADJUSTING DEVICE

(71) Applicant: Schaeffler Technologies AG & Co. KG, Herzogenaurach (DE)

(72) Inventor: Ali Bayrakdar, Röthenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/045,610

(22) PCT Filed: Mar. 7, 2019

(86) PCT No.: PCT/DE2019/100203
§ 371 (c)(1),
(2) Date: Oct. 6, 2020

(87) PCT Pub. No.: WO2019/196974
PCT Pub. Date: Oct. 17, 2019

(65) Prior Publication Data

US 2021/0199027 A1 Jul. 1, 2021

(30) Foreign Application Priority Data

Apr. 11, 2018 (DE) ..... 10 2018 108 534.6

(51) Int. Cl.
*F01L 1/34* (2006.01)
*F01L 1/344* (2006.01)
(Continued)

(52) U.S. Cl.
CPC ..... *F01L 1/3442* (2013.01); *F01L 1/024* (2013.01); *F01L 1/047* (2013.01);
(Continued)

(58) Field of Classification Search
CPC ..... F01L 1/3442; F01L 1/047; F01L 1/024; F01L 2001/0476; F01L 2001/0475; F01L 2001/34426; F01L 2250/04; F01L 2810/02
See application file for complete search history.

(56) References Cited

U.S. PATENT DOCUMENTS

2010/0294223 A1 11/2010 Adachi et al.
2014/0102392 A1* 4/2014 Busse ..... F01L 1/344 123/90.17
2015/0275707 A1 10/2015 David et al.

FOREIGN PATENT DOCUMENTS

CN 105358800 A 2/2016
CN 205206900 U 5/2016
(Continued)

*Primary Examiner* — Zelalem Eshete

(57) ABSTRACT

The disclosure relates to a camshaft adjusting device with a dry belt, a central valve arranged within a camshaft adjuster, and an actuator acting on the central valve. An oil-tight wet space is formed by the camshaft adjuster and the actuator or a component supporting the actuator, and oil present in the wet space can be evacuated by means of an oil path. A portion of this oil path extends axially through the output element of the camshaft adjuster. This oil path can pass the end-side contact face between the output element and camshaft, opening out into an axial bore of the camshaft which is distanced radially from the axis of rotation of the camshaft adjusting device. The axial bore runs beneath an oil feed connection formed on the outer surface of the camshaft for feeding oil to the central valve.

20 Claims, 1 Drawing Sheet

(51) Int. Cl.
*F01L 1/047* (2006.01)
*F01L 1/02* (2006.01)

(52) U.S. Cl.
CPC ..... *F01L 2001/0475* (2013.01); *F01L 2001/0476* (2013.01); *F01L 2001/34426* (2013.01); *F01L 2250/04* (2013.01); *F01L 2810/02* (2013.01)

(56) References Cited

FOREIGN PATENT DOCUMENTS

| | | | |
|---|---|---|---|
| CN | 106762003 | A | 5/2017 |
| DE | 102012214963 | A1 | 2/2014 |
| DE | 102013223112 | A1 | 6/2014 |
| DE | 102013212935 | A1 | 1/2015 |
| DE | 102013212942 | A1 | 1/2016 |
| DE | 102014213250 | A1 | 1/2016 |
| DE | 102015113615 | A1 | 3/2016 |
| DE | 102016106241 | A1 | 10/2016 |
| JP | 2014109260 | A | 6/2014 |
| JP | 2016044652 | A | 4/2016 |
| JP | 2016200031 | A | 12/2016 |

* cited by examiner

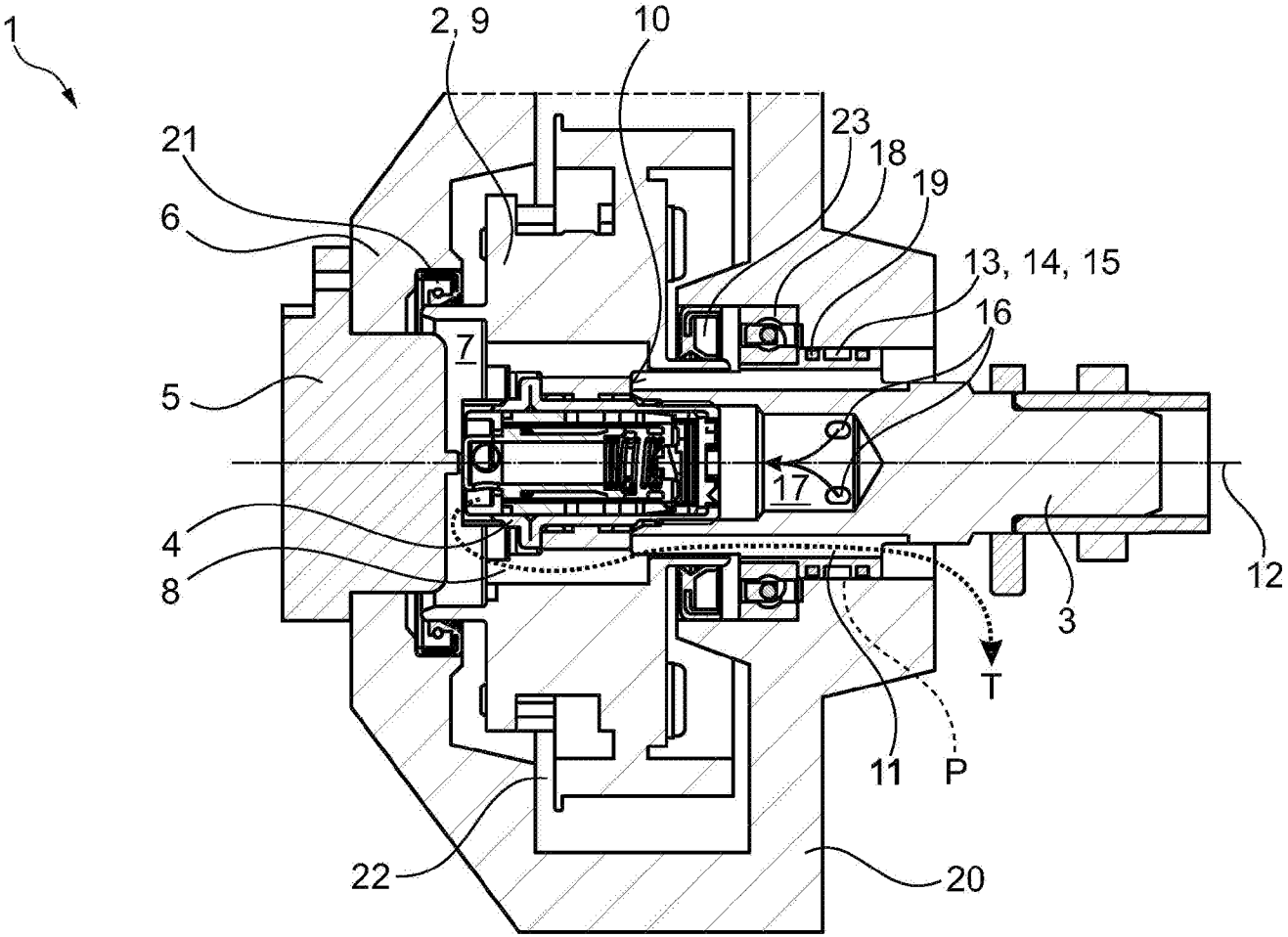
1
2, 9
10
23
18
19
13, 14, 15
16
12
3
T
P
11
20
17
7
21
6
5
4
8
22

CAMSHAFT ADJUSTING DEVICE

CROSS-REFERENCE TO RELATED APPLICATIONS

This application is the U.S. National Phase of PCT Application No. PCT/DE2019/100203 filed on Mar. 7, 2019 which claims priority to DE 10 2018 108 534.6 filed on Apr. 11, 2018, the entire disclosures of which are incorporated by reference herein.

TECHNICAL FIELD

This disclosure relates to a camshaft adjusting device.

BACKGROUND

Camshaft adjusters are used in internal combustion engines to vary the control times of the combustion chamber valves to be able to variably design the phase relationship between a crankshaft and a camshaft within a defined angular range, between a maximum early and a maximum late position. Adjusting the control times to the current load and rotational speed reduces consumption and emissions. For this purpose, camshaft adjusters are integrated into a drivetrain, via which torque is transmitted from the crankshaft to the camshaft. This drivetrain can be designed, for example, as a belt, chain or gear drive.

In the case of a hydraulic camshaft adjuster, the output element and the drive element form one or more pairs of pressure chambers which act against one another and can be acted upon by hydraulic medium. The drive element and the output element are arranged coaxially. The filling and emptying of individual pressure chambers create a relative movement between the drive element and the output element. The spring, which acts rotationally between the drive element and the output element, pushes the drive element in an advantageous direction with respect to the output element. This advantageous direction can be the same or opposite to the direction of rotation.

One type of hydraulic camshaft adjuster is a vane cell adjuster. The vane cell adjuster has a stator, a rotor and a drive wheel having external teeth. The rotor is usually designed as an output element so that it can be connected in a rotationally fixed manner to the camshaft. The drive element includes the stator and the drive wheel. The stator and the drive wheel are connected to one another in a rotationally fixed manner or alternatively are formed in one piece with one another. The rotor is arranged coaxially to the stator and inside the stator. The rotor and the stator, having radially extending vanes thereof, form oppositely acting oil chambers which can be acted upon by oil pressure and enable a relative rotation between the stator and the rotor. The vanes are either formed in one piece with the rotor or the stator or are arranged as "inserted vanes" in grooves provided for this purpose in the rotor or the stator. The vane cell adjusters also have various sealing covers. The stator and the sealing cover are secured together using several screw connections.

Another type of hydraulic camshaft adjuster is the axial piston adjuster. Here, a displacement element is axially displaced via oil pressure, which generates a relative rotation between a drive element and an output element via helical gears.

Another design of a camshaft adjuster is the electromechanical camshaft adjuster, which has a triple-shaft gear (for example a planetary gear or a shaft drive). One of the shafts forms the drive element and a second shaft forms the output element. Rotational energy can be supplied to the system via the third shaft by means of an actuating device, for example an electric motor or a brake, or can be removed from the system to initiate an adjustment. A spring can also be arranged which supports or returns the relative rotation between the drive element and the output element.

A camshaft adjusting device has a camshaft adjusting mechanism which can adapt the relative angular position between the camshaft and the crankshaft to the operating modes of the internal combustion engine, the latter being fastened to a camshaft and arranged largely coaxially therewith.

DE 10 2013 212 935 A1 shows a camshaft adjusting device of a dry belt drive, which has a seal in the form of radial shaft sealing rings both on the camshaft adjuster-facing side and on the actuator-facing side of the camshaft adjuster. In particular, in an oil chamber on the actuator side, operating oil or leakage oil may collect, which must be removed from the oil chamber. For this purpose, DE 10 2013 212 935 A1 proposes an oil return through an opening which penetrates the output element of the camshaft adjuster in the axial direction and which can discharge the oil from this oil chamber to the tank.

SUMMARY

The object of the disclosure is to provide a camshaft adjusting device which has an alternative oil return.

According to the disclosure, this object is achieved by the features described herein.

Thus, a camshaft adjusting device of a control drive having a dry belt and a camshaft is provided. The camshaft adjusting device includes a camshaft adjuster that is connected to the camshaft, a central valve arranged within the camshaft adjuster, and an actuator acting on the central valve. An oil-tight wet space is formed by the camshaft adjuster and the actuator, or a component supporting the actuator, and the oil present in the wet space can be evacuated by means of an oil path. A portion of this oil path extends axially through the output element of the camshaft adjuster, which can pass the end-side contact face (or contact interface) between the output element and the camshaft opening out into an axial bore of the camshaft which is distanced radially from the axis of rotation of the camshaft adjusting device. This axial bore extends or runs beneath an oil feed connection formed on the outer surface of the camshaft for feeding oil to the central valve.

This ensures that the oil is removed from the camshaft adjusting device in a particularly simple manner without flowing through the roller bearing, as a result of which splashing losses and air entry are avoided. As a result, the service life of the other oil-lubricated components of the internal combustion engine can be increased because the enrichment with air has been further reduced. Back pressure is also avoided and the wet space can be evacuated quickly, in particular at low temperatures.

In one embodiment of the disclosure, the oil feed connection is designed as a circumferential groove on the outer surface of the camshaft, which can guide the oil via at least one radial bore into a concentric bore of the camshaft to be fed to the central valve.

The radial bore (oil feed) and the axial bore (oil discharge) are arranged skewed in relation to one another without these communicating fluidically with one another.

In one embodiment, the oil feed connection is arranged adjacent to a roller bearing of the camshaft. The rolling elements of the roller bearing are advantageously not in fluid communication with the oil path, which evacuates the wet space.

In one embodiment of the disclosure, rolling elements of a roller bearing that support the camshaft are not flushed or flowed through by the oil path according to the disclosure. The roller bearing is lubricated by means of lifetime lubrication, in which the bearing is filled with lubricant once and the appropriate seals ensure that this lubricant is largely retained in the roller bearing over the service life thereof.

In one embodiment of the disclosure, a seal is arranged between the oil feed connection and the roller bearing. This prevents the supplied oil from penetrating through the gap(s) formed by two parts that are moved relative to one another and possibly mixing with the lubricant of the roller bearing or rinsing out same. Such gaps can reduce or favor an oil exchange, due to the temperature-dependent viscosity, and also a sealing effect caused by a change in gap height due to temperature.

In one embodiment, the oil path opens into the cylinder head that supports the camshaft. In this way, the oil discharged through the oil path can be returned to the oil reservoir (tank) and is available again for the components to be lubricated.

The arrangement according to the disclosure achieves a higher quality of the returned oil or the oil discharged from the camshaft adjusting device.

BRIEF DESCRIPTION OF THE DRAWINGS

An exemplary embodiment of the disclosure is shown in the FIGURE, wherein:

FIG. 1 shows a section through the camshaft adjusting device according to the disclosure.

DETAILED DESCRIPTION OF THE EMBODIMENTS

FIG. 1 shows a section through the camshaft adjusting device 1 according to the disclosure.

The components of the camshaft adjusting device 1 according to the disclosure include the camshaft adjuster 2, the camshaft 3, the central valve 4, and the actuator 5 which is designed as a central magnet and controls the central valve 4, which in turn controls the camshaft adjuster 2. All of the aforementioned components are supported directly or indirectly by the cylinder head 20. For example, the actuator 5 is supported by a component 6 which is connected to the cylinder head 20. A wet space 7 is formed between the actuator 5, the component 6, and the camshaft adjuster 2, which wet space is sealed with a seal 21 from the dry belt space 22 in a fluid-tight manner.

The camshaft adjuster 2 having the output element 9 is only shown schematically. A detailed illustration of the actuator 5 has been omitted, since it is known from the prior art.

The wet space 7 collects the oil emerging from the end side of the central valve 4, where it can be returned to the hydraulic working chamber, for example, and/or can be discharged to a tank T according to the arrow.

The oil supplied from a pressure medium source P first enters the camshaft adjusting device 1 via an oil feed connection 14 of the camshaft 3. By means of a circumferential groove 15 formed by the camshaft 3 and arranged on the outer surface 13 of the camshaft 3, the oil can be distributed around the circumference of the camshaft 3 and reach the radial bores 16 of the camshaft 3. Via these radial bores 16, the oil passes in the direction of the axis of rotation 12 into a bore 17 concentric with the camshaft 3, into which the central valve 4 partially projects. The supplied oil meets the central valve 4 on the end side in the bore 17 and, depending on the operating state, is distributed thereby to the hydraulic working chambers of the camshaft adjuster 2. The oil to be removed from the hydraulic working chambers emerges from the actuator-side end of the central valve 4 and into the wet space 7, where it can be collected.

An oil path 8 is provided for evacuating the wet space 7 which extends through the entire axial length of the camshaft adjuster 2 and meets the contact face 10 between the camshaft adjuster 2 and the camshaft 3. There the oil path 8 opens into an axial bore 11 of the camshaft 3. This runs or extends beneath a camshaft-side seal 23 of the camshaft adjuster 2, which seals the dry belt space 22 from a roller bearing 18 arranged adjacent to the seal 23. The roller bearing 18 supports the camshaft 3 in the cylinder head 20. In the further course of the axial bore 11, it first runs or extends beneath or radially inwardly of the roller bearing 18 itself and then the oil feed connection 14, which is designed as a groove 15. A seal 19 is arranged between the roller bearing 18 and the oil feed connection 14 and seals the oil feed connection 14 to the roller bearing 18. The seal 19 can be present several times and flanks the groove 15 so that no oil flows from the oil feed connection 14 along the outer surface 13 of the camshaft 3 and wets adjacent components. The axial bore 11 is arranged parallel to and at a distance from the axis of rotation 12, but has a smaller radial distance from the axis of rotation 12 than the circumferential groove 15. Thus, the volume flows "from P" and "to T" intersect in the camshaft 3 in a skewed manner without communicating directly with each other. The oil to be discharged can thus be drained very directly into the cylinder head 20 without, for example, flowing through the roller bearing 18 or being deflected through further bores in the cylinder head 20.

LIST OF REFERENCE CHARACTERS

1 Camshaft adjusting device
2 Camshaft adjuster
3 Camshaft
4 Central valve
5 Actuator
6 Component
7 Wet space
8 Oil path
9 Output element
10 Contact face
11 Axial bore
12 Axis of rotation
13 Outer surface
14 Oil feed connection
15 Circumferential groove
16 Radial bore
17 Concentric bore
18 Roller bearing
19 Seal
20 Cylinder head
21 Seal
22 Dry belt space
23 Seal
P Pressure medium source
T Tank

The invention claimed is:

1. A camshaft adjusting device configured for a timing drive with a dry belt, the camshaft adjusting device comprising:

a camshaft adjuster connected to a camshaft and configured to rotate about a rotational axis, a central valve arranged within the camshaft adjuster, the central valve configured to control a flow of oil to the camshaft adjuster, and an actuator acting on the central valve, and an oil-tight wet space formed by the camshaft adjuster and one of either the actuator or a component supporting the actuator, and an oil path configured to evacuate oil from the wet space, a portion of the oil path extending axially through a rotor of the camshaft adjuster, and the oil path configured to: i) extend past a contact interface between the rotor and the camshaft, and ii) fluidly connect to an axial bore arranged within the camshaft, and the axial bore:

distanced radially from the rotational axis of the camshaft adjusting device, and configured radially inwardly of an oil feed connection formed on an outer surface of the camshaft, the oil feed connection configured to provide oil to the central valve, wherein the oil feed connection is configured as a circumferential groove on the outer surface of the camshaft.

2. The camshaft adjusting device according to claim 1, wherein the oil feed connection is configured as a circumferential groove on the outer surface of the camshaft, the circumferential groove fluidly connected via at least one radial bore, to a concentric bore of the camshaft, and the concentric bore configured to feed oil into the central valve, wherein the oil feed connection is configured as a circumferential groove on the outer surface of the camshaft.

3. The camshaft adjusting device according to claim 1, further comprising a roller bearing configured to support the camshaft, the roller bearing arranged between the oil feed connection and the camshaft adjuster in the axial direction.

4. The camshaft adjusting device according to claim 3, wherein the oil path does not flow through rolling elements of the roller bearing.

5. The camshaft adjusting device according to claim 3, wherein a seal is arranged axially between the oil feed connection and the roller bearing.

6. The camshaft adjusting device according to claim 1, wherein the oil path exits into a cylinder head of an internal combustion engine.

7. A camshaft adjusting device configured for a timing drive with a dry belt, the camshaft adjusting device comprising:

a camshaft adjuster connected to a camshaft and configured to rotate about a rotational axis, an actuator configured to actuate the camshaft adjuster, an oil-tight wet space formed by the camshaft adjuster and one of either the actuator or a component supporting the actuator, and an oil path configured to evacuate oil from the wet space, the oil path having:

a first portion extending axially within the camshaft adjuster from the wet space, and a second portion including an axially extending first bore within the camshaft, the axially extending first bore arranged radially inwardly of an oil feed connection of the camshaft, the oil feed connection configured to provide oil to the camshaft adjuster, wherein the oil feed connection is configured as a circumferential groove on the outer surface of the camshaft.

8. The camshaft adjusting device of claim 7, further comprising a roller bearing configured to support the camshaft, the roller bearing arranged between the oil feed connection and the camshaft adjuster in an axial direction.

9. The camshaft adjusting device of claim 8, further comprising a seal arranged between the oil feed connection and the roller bearing in the axial direction.

10. The camshaft adjusting device of claim 7, wherein the axially extending first bore is parallel to the rotational axis.

11. The camshaft adjusting device of claim 7, wherein the second portion has an exit end, the exit end configured to exit oil into a cylinder head of an internal combustion engine.

12. The camshaft adjusting device of claim 11, wherein the oil feed connection is arranged axially between the exit end and the camshaft adjuster.

13. The camshaft adjusting device of claim 11, wherein the oil feed connection is arranged axially between the exit end and a roller bearing, the roller bearing arranged to support the camshaft.

14. The camshaft adjusting device of claim 7, wherein a sum of a first axial length of the first portion and a second axial length of the second portion is greater than an axial length of the camshaft adjuster.

15. The camshaft adjusting device of claim 7, wherein the camshaft further comprises a second bore arranged radially inwardly of the axially extending first bore, the second bore fluidly connected to the oil feed connection and configured to provide oil to the camshaft adjuster.

16. The camshaft adjusting device of claim 15, further comprising a central valve, the central valve configured to: i) receive oil from the second bore; and, ii) control a flow of oil to the camshaft adjuster.

17. A camshaft adjusting device configured for a timing drive with a dry belt, the camshaft adjusting device comprising:

a camshaft adjuster configured to rotate about a rotational axis, an actuator configured to actuate the camshaft adjuster, an oil-tight wet space formed by the camshaft adjuster and one of either the actuator or a component supporting the actuator, a camshaft attached to the camshaft adjuster at a first axial position on the camshaft, the camshaft having:

an oil feed connection formed on an outer surface of the camshaft at a second axial position on the camshaft, a first axially extending bore configured to receive oil from the oil feed connection, and a second axially extending bore configured to exit oil from the wet space, and a roller bearing arranged to support the camshaft at a third axial position on the camshaft, the third axial position located between the first axial position and the second axial position.

18. The camshaft adjusting device of claim 17, wherein the second axially extending bore extends completely through the second axial position and the third axial position.

19. The camshaft adjusting device of claim 18, further comprising a third axially extending bore arranged within the camshaft adjuster, the third axially extending bore arranged axially between the oil-tight wet space and the second axially extending bore, and the second and third axially extending bores configured to evacuate oil from the oil-tight wet space to a cylinder head of an internal combustion engine.

20. The camshaft adjusting device of claim 19, further comprising a seal arranged between the roller bearing and the oil feed connection.

* * * * *